United States Patent [19]

Garneau

[11] Patent Number: 4,796,866

[45] Date of Patent: Jan. 10, 1989

[54] RAILING STRUCTURE

[76] Inventor: Jocelyn C. Garneau, 1, rue Verret, St-Emile, Quebec, Canada, G0A 3N0

[21] Appl. No.: 77,507

[22] Filed: Jul. 24, 1987

[51] Int. Cl.[4] ..... E04H 17/14

[52] U.S. Cl. ..... 256/59; 256/19

[58] Field of Search ..... 256/59, 65, 19; 52/690, 52/727, 731

[56] References Cited

U.S. PATENT DOCUMENTS

| | | | |
|---|---|---|---|
| 813,931 | 2/1906 | Hinds | 256/19 |
| 2,945,679 | 7/1960 | Blum | 256/65 |
| 3,289,381 | 12/1966 | Blum et al. | 256/65 X |
| 3,356,392 | 12/1967 | Blum et al. | 256/65 X |
| 3,405,915 | 10/1968 | Blum et al. | 256/65 |
| 3,503,589 | 3/1970 | Moore | 256/19 |
| 3,554,494 | 1/1971 | Bee | 256/19 |
| 3,804,374 | 4/1974 | Thom | 256/59 |

FOREIGN PATENT DOCUMENTS

| | | | |
|---|---|---|---|
| 619682 | 5/1961 | Canada | 256/59 |

*Primary Examiner*—Andrew V. Kundrat
*Attorney, Agent, or Firm*—Roland L. Morneau

[57] ABSTRACT

A railing which is constituted of ornamented uprights hiding the fastening means holding the railing together. The uprights are made of a soft core having a longitudinal groove on the front and rear faces on which are glued rigid facing plates having a ridge thereon. The two lateral faces are covered by a thin protective plate. The lower end of each upright has a recess in which a hard block member is mounted to secure the upright to a base member. The upper end of the upright is secured to a hand-rail by a screw member emerging in the core and covered by the facing plates.

8 Claims, 2 Drawing Sheets

RAILING STRUCTURE

BACKGROUND OF THE INVENTION

1. Field of the Invention

The present invention relates to a railing assembly and more particularly to uprights for railings.

2. Prior Art

Canadian Pat. No. 619,682 is directed to a composite wood and metal rail structure. The wood facing is held to the metal post by a screw and the screw is hidden by a spring clip. The wood is not used as a reinforcing means for the post and is not glued to it. The hole in which the screw is inserted is not automatically covered by a wood facing.

In U.S. Pat. No. 3,804,374, a hand-rail structure comprises: a pair of spaced posts, made of metal to define a space for receiving wood filler pieces. A bolt which holds the posts together needs to be hidden by a press-fit plastic cap.

BRIEF SUMMARY OF THE INVENTION

The railing according to the invention comprises uprights which makes use for its care, of material which are cheap such as soft wood or press-wood or plastic. These materials have a weak resistance to bending. The uprights used for these railings are arranged with reinforcing facing plates which provides the desired rigidity to the upright. The facing plates are also used to hide the means for fixing the uprights and to ornament the railing.

An upright comprises a tubular core member having at least one longitudinal groove, a facing plate having a ridge of a size corresponding to said groove and which is adheringly mounted therto. A block member made of a hard material is adheringly inserted into a recess provided at the lower end of the said upright.

The core member has a transversal perforation emerging in the groove at its upper end.

A railing is formed of a plurality of uprights fixed to a base member with securing means connecting the block member to the base member and at the upper end of the upright to a hand-rail with fastening means passing through the perforation.

DETAILED DESCRIPTION OF THE INVENTION

Figure 1:
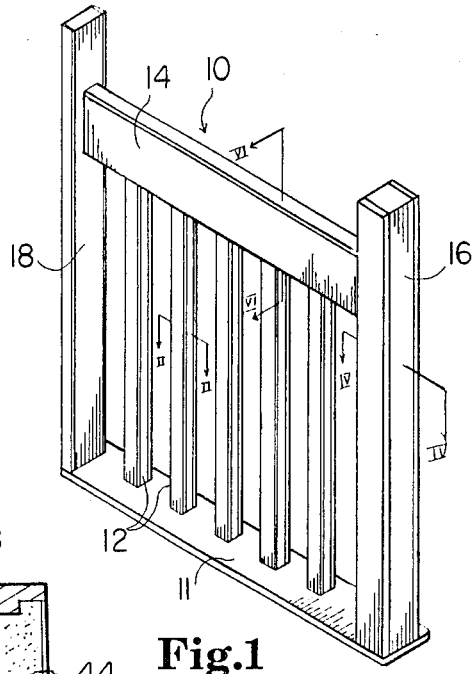
FIG. 1 is a perspective view of a rail according to the invention.

FIG. 1 illustrates a railing structure 10 mounted on a horizontal base 11. A plurality of intermediate or central uprights 12 are fixed between the base 11 and a hand-rail 14. A terminal upright 16 having larger dimensions than the intermediate uprights 12 is mounted at the end of the railing. The other end of the railing structure is fixed to a wall member 18.

Figure 2:
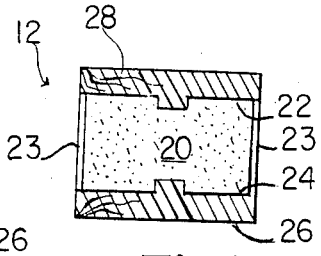
FIG. 2 is a cross-sectional view of an upright along line II—II of FIG. 1.
Figure 3:
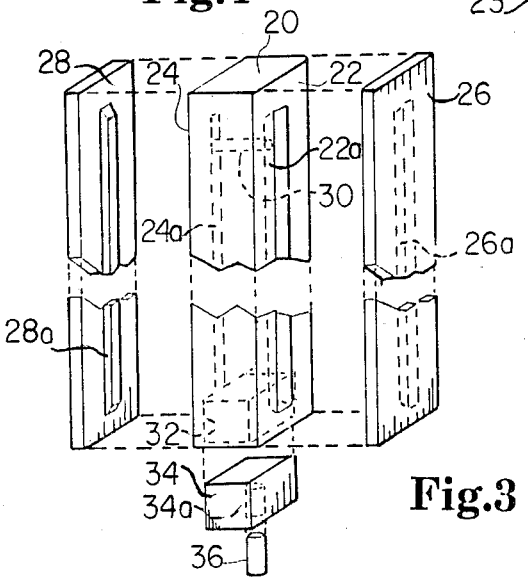
FIG. 3 is an exploded view of the upright according to FIG. 2.

As shown in FIGS. 2 and 3, the upright 12 comprises a core member 20 made of press-wood. The member 20 has a rectangular cross-section.

The front and rear faces 22 and 24 have a longitudinal medial groove **22*a* and 24*a* respectively covered by facing plates 26 and 28. Each of these plates have on their internal face a ridge 26*a* and 28*a* fittingly corresponding to the grooves 22*a* and 24*a*. The facing plates 26 and 28 are, at one time, in the process of assembly, glued to the core member 20. The core member 20 is also provided with a transversal aperture 30**, the use of which will be explained latter.

The core member 20 has a cubical recess 32 in its lower end to allow a block member 34 having corresponding dimensions to be tightly glued therein. The block 34 has a small cylindrical recess 34a in its lower end in which is glued a short cylinder 36. A part of the cylinder 36 projects outside the block 34 and is used to secure the upright 12 in a corresponding aperture in the base 11.

The two lateral sides of the core member 20 are covered by a thin protective sheet of plastic such as melamine or the like. As stated above, the core member is made of soft wood or press-wood. Such material, when formed in the shape of elongated bars is easily breakable and has a weak resistance to bending in the case of railings. This is a serious disadvantage although it is desirable to use it on account of its low cost. According to the invention, its use is made possible by reinforcing it with the facing plates 26 and 28 made of hard wood. Furthermore, the facing plates are used for ornamenting the railing considering that it provides a rich appearance which can be varied according to the kind of hard wood used. The ornamentation can be additionally diversified by a variety of combination of colours with the protective sheets 23.

The block member 34 and the cylinder 36 are made of hard wood to increase the solidity of the retention between the core 20 and the base 11.

Figure 4:
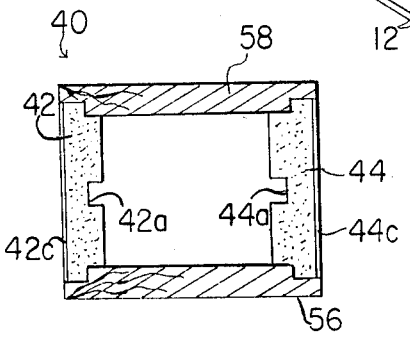
FIG. 4 is a cross-sectional view of another embodiment of an upright along line IV13 IV of FIG. 1.

In the case of an upright 16 located at the end of the railing 10, the dimensions of the contour are larger and the core 40 of the upright is partly hollow. The core is formed by two slabs 42 and 44 made of press-wood held together in spaced relationship by three block members or spacers 46, 48 and 50 glued to the slabs 42 and 44. The slabs are covered by a protective plastic sheet **42*c* and 44*c* (see FIG. 4) such as melamine. In order to increase the retention between the slabs 42 and 44 and the spacers 46, 48 and 50, longitudinal grooves 42*a* and 44*a* are provided inside the slabs 42 and 44 to receive the ridges 46*a*,48*a* and 50*a* in the spacers 46, 48 and 50. The bottom spacer 46 has a central perforation 52 for receiving a large screw 54 which retains the upright 16 to the base 11. The facing plates 56 and 58 are made of hard wood and glued to the edges of the slabe 42 and 44 to reinforce the latter. In order to increase the retention of the facing plates 56 and 58 on the slabs 42 and 44, the facing plates have a protrudings surface 56*a* and 58*a* fitting into checks 42*b* and 44*b* made in the ledges of the slabs 42 and 44**.

This arrangement corresponds to the combination of grooves **22*a* and 24*a* and ridges 26*a* and 28*a* shown in FIGS. 2 and 3**.

Figure 6:
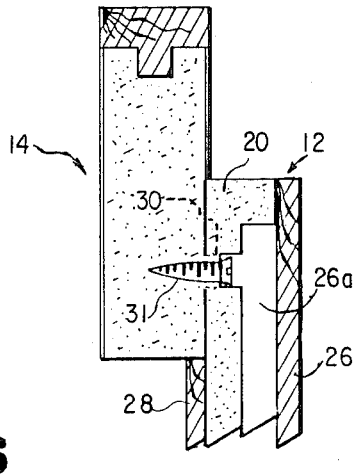
FIG. 6 is a cross-sectional view along line VI—VI of FIG. 1.

The upper end of the upright 12 is fixed to the hand-rail 14 as shown in FIG. 6. The upper end of the facing plate 28 is cut away and the core member 20 is applied directly against the side of the hand-rail 14. Before the facing plate 26 is glued, a screw 31 is introduced into the aperture 30 and threadedly engages the hand-rail 14. The head of the screw 31 is hidden by the facing plate 26.

Figure 5:
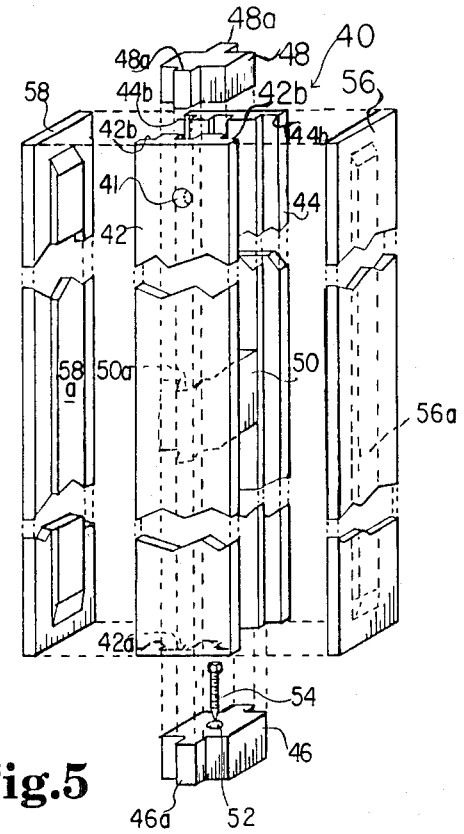
FIG. 5 is an exploded view of the upright according to FIG. 4.

The present railing structure is characterized by the possibility of hiding all connecting and securing means. The screw 54 (FIG. 5) is hidden inside the core 40 and the cylinder 36 is also invisible.

The terminal upright 16 can be fastened to the end of the hand-rail 14 by a screw arrangement which can be introduced in the hole 41 (FIG. 5) in slab 42 through the cavity inside the upright before gluing the plates 56 and 58.

The railing according to the invention can be sold as kits, i.e. partly assembled. The lenght of the railing and the number of uprights may vary from one installation to another. Also the facing plates are not glued to the core before installation to allow the screws 54 (FIG. 5) and 31 (FIG. 6) to be inserted in the core and fixed to an adjacent part.

Although it has been contemplated to make the core member 20 and the slabs 42, with press-wood and the facing plates 26, 28, 56 and 58 with hard wood, other material having equivalent characteristics can be used. The core member and the slabs can be made of soft wood or plastic having a weak resistance to bending and the facing plates can be made of a variety of hard rigid material such as metal or rigid plastic.

I claim:

1. An upright for railing comprising an elongated core member made of a material having a weak resistance to bending, the said core member having a rectangular cross-section surrounded by a front and a rear face and two lateral faces, the said front and rear faces being provided with a longitudinal groove and the said lateral faces being covered by a thin protective sheet, facing plates made of solid and rigid material covering said front and rear faces, each of said plates being provided with a ridge correspondingly fitting in one of said grooves, the said facing plates being adheringly mounted to said core member. A block member made of solid material adheringly fitted in a recess provided in the lower end of said core member, means for securing said block member to a base member, the said core member being provided at its upper end with a perforation emerging in said groove, the said perforation adapted to receive a screw hidden from view by one of the facing members for threadedly engaging said upright to an adjacent structure.

2. An upright as recited in claim 1, wherein the facing plates are glued to the core member.

3. An upright as recited in claim 1, wherein the said core member comprises a pair of slabs secured in parallel relationship to a pair of spacers mounted at both ends of said slabs.

4. An upright as recited in claim 1, wherein the said block member adjacent said base member comprises a tubular protuberance extending downwardly, the said protuberance adapted to fit snuggly into the said base member.

5. An upright as recited in claim 3, wherein the said spacer adjacent said base member is provided with a tubular channel extending downwardly therethrough, the said channel adapted to receive means for securing the said spacer adjacent said base member to said base member.

6. A railing comprising a plurality of uprights as recited in claim 1, a horizontal hand-rail having two lateral faces covered by a thin protective sheet, a top face provided with a facing plate, wherein the upper portion of said uprights are abuting sideways on the said horizontal hand-rail, said screw connecting each of said uprights to said horizontal hand-rail.

7. A railing as recited in claim 6 comprising a terminal upright fixed on said base at the end of said horizontal hand-rail, the said terminal upright having a core member made of a pair of parallel slabs spaced by a pair of spacers adheringly mounted to the slabs at both ends thereof, one of said slabs abuting sideways against the end of said hand-rail at the upper end of said one slab, said one slab being provided with an aperture emerging inside said core member, and means for threadedly engaging said one slab to said hand-rail through said aperture and means for securing said spacer, located at the lower end of said upright to said base member.

8. A kit for a railing comprising: a plurality of central uprights, a terminal upright and a horizontal hand-rail adapted to connect the said central and terminal uprights, each of said central uprights comprising an elongated core member made of press-wood having a rectangular cross-section surrounded by a front and a rear face and two lateral faces, the said lateral faces being covered by a thin protective sheet, the said front and rear faces being provided with a longitudinal groove, facing plates made of hard wood adapted to cover said front and rear faces. The said facing plates being provided with a ridge adapted to fit in said groove and glued therein a block member made of hard wood adheringly inserted in a recess provided in the lower end of said core member, means for securing said block member to a base member, the said core member being provided at its upper end with a perforation emerging in said groove, the said perforation adapted to receive a screw hidden from view by one of the facing members for threadedly engaging said upright to said hand-rail, the said terminal upright comprising a pair of parallel slabs made of press-wood secured in parallel relationship to a pair of spacers at both ends of the said slabs, a pair of facing members adapted to be mounted on each side of the pair of slabs, the said facing members being provided with a protuberance on its internal face corresponding to the space between the said slabs for allowing an adherence by glue between the said facing members and the said slabs. The said spacer located at the lower end of the terminal upright being provided with a channel extending downwardly therethrough, means adapted to securing said terminal upright to said base member through said channel, an aperture provided in one of said slabs adjacent the upper end of said terminal upright for allowing connection between the said terminal upright and the hand-rail.

* * * * *